US012690651B1

(12) United States Patent
Anderson, Jr. et al.

(10) Patent No.: US 12,690,651 B1
(45) Date of Patent: Jul. 28, 2026

(54) PERSONAL SECURITY TOTE

(71) Applicants: Robert E. Anderson, Jr., Las Vegas, NV (US); Kristy Anderson, Las Vegas, NV (US)

(72) Inventors: Robert E. Anderson, Jr., Las Vegas, NV (US); Kristy Anderson, Las Vegas, NV (US)

( * ) Notice: Subject to any disclaimer, the term of this patent is extended or adjusted under 35 U.S.C. 154(b) by 531 days.

(21) Appl. No.: 18/136,610

(22) Filed: Apr. 19, 2023

Related U.S. Application Data

(60) Provisional application No. 63/332,669, filed on Apr. 19, 2022.

(51) Int. Cl.

| | |
|---|---|
| ***A45C 13/24*** | (2006.01) |
| ***A45C 3/00*** | (2006.01) |
| ***A45C 3/06*** | (2006.01) |
| ***A45C 13/10*** | (2006.01) |
| ***A45C 15/06*** | (2006.01) |

(52) U.S. Cl.
CPC ..... *A45C 13/24* (2013.01); *A45C 3/001* (2013.01); *A45C 3/06* (2013.01); *A45C 13/1084* (2013.01); *A45C 13/1092* (2013.01); *A45C 15/06* (2013.01)

(58) Field of Classification Search
CPC ..... A45C 13/24; A45C 3/002; A45C 3/06; A45C 11/1084; A45C 11/1092; A45C 15/06
USPC ..... 150/106
See application file for complete search history.

(56) References Cited

U.S. PATENT DOCUMENTS

| | | | | |
|---|---|---|---|---|
| 5,281,953 | A | 1/1994 | Torres et al. | |
| 5,955,948 | A | 9/1999 | Howell | |
| 7,160,028 | B1 * | 1/2007 | Linday | A45C 9/00 150/108 |
| 7,961,914 | B1 | 6/2011 | Smith | |
| 8,799,906 | B2 | 8/2014 | Garza et al. | |
| 8,847,760 | B1 | 9/2014 | Watkins, Jr. | |
| 9,078,503 | B1 | 7/2015 | Gilman | |
| 10,188,187 | B1 | 1/2019 | Smith | |
| 10,617,188 | B1 | 4/2020 | Hooks | |
| 11,166,503 | B2 * | 11/2021 | Juhasz | G06F 3/0446 |
| 2004/0104820 | A1 * | 6/2004 | Sosna | G08B 25/016 340/686.1 |
| 2005/0056674 | A1 | 3/2005 | Renn | |
| 2014/0061068 | A1 * | 3/2014 | Diaz | A45C 15/06 206/37 |
| 2021/0100330 | A1 * | 4/2021 | Haynes | A45C 15/06 |

* cited by examiner

*Primary Examiner* — Sue A Weaver
(74) *Attorney, Agent, or Firm* — Cramer Patent & Design, PLLC.; Aaron R. Cramer

(57) ABSTRACT

A personal security tote is a traditionally configured purse made of Kevlar®, straps than can be released by an electronic buckle to allow securement to stationary objects, a voice recognition system, fingerprint reader, keypad, or interface to a smart phone via a Bluetooth® connection, a front mount screen displays status of the purse, a motion sensor that detects any attempt to move it or gain access, an alarm which activates an internal alarm or siren, an internal GPS, operating in conjunction with a smart phone app, a Wi-Fi transmitter, and a cellular transmitter, and a battery which powers the screen and LED lights on the interior of the purse.

2 Claims, 6 Drawing Sheets

PERSONAL SECURITY TOTE

RELATED APPLICATIONS

The present invention was first described in and is a continuation of U.S. Provisional Application No. 63/332,669 filed Apr. 19, 2022, the entire disclosures of which are incorporated herein by reference.

FIELD OF THE INVENTION

The present invention relates to a personal tote that incorporates security features for alerting the owner of unauthorized possession or opening.

BACKGROUND OF THE INVENTION

In today's society, one must be constantly aware that they can be a victim of theft at almost any time and any location. Such theft typically occurs when the thief can take advantage of a person who is not fully aware or cognizant of what is going on around them. A typical example of such a theft is when a thief gains access to a victim's tote, such as a purse. Whether such theft is active as is the case with a tote snatching or whether the theft is accidental such as what occurs when a tote is lost or left behind, the contents of the tote provide a literal goldmine for the thief. Not only via monetary access through lost currency, but also through identity theft from credit cards, identification cards, drivers' licenses, and the like. Finally, should the tote contain other items such as jewelry, firearms, or other valuable or dangerous items, the loss becomes more financially and safety troublesome.

Accordingly, there exists a need for means by which a tote and its contents can be protected at all times whether or not in the possession of the owner. The use of the security tote provides storage and protection for all personally carried items, in a manner which is not only quick, easy and effective, but safe and secure as well.

SUMMARY OF THE INVENTION

To achieve the above and other objectives, the present invention provides for a security tote having an interior and an exterior, a lower front wall, an opposing lower rear wall, an upper front wall attached to or integral with the lower front wall, an upper rear wall attached to or integral with the lower rear wall, a pair of side walls attached to or integral with a plurality of perimeter side edges of the lower front wall, the upper front wall, the lower rear wall, and the upper rear wall, a first tote fastener disposed on an upper perimeter edge of the upper front wall, a second tote fastener disposed on an upper perimeter edge of the upper rear wall, an on-board microprocessor electronically communicating between a removable fastening means and a power supply located in the interior of the security tote, a first handle having a first end fixedly coupled to a first side of the upper front wall with a first handle fastener and removably coupled to another area of the first side of the upper front wall with a second handle fastener, and a second handle having a first end fixedly coupled to a first side of the upper rear wall with another first handle fastener and removably coupled to another area of a first side of the upper rear wall with another second handle fastener. A breach of the first tote fastener and the second tote fastener when sensed generates an unauthorized breach alarm.

The first tote fastener may include the removable fastening means to the second tote fastener thereby completely sealing the interior. The first handle fastener may be a semi-permanent fastener. The second handle fastener may a buckle. The second handle fastener may be a latch. The second handle fastener may be energized by the power supply contained in the interior of the security tote. The power supply may be selected from the group consisting of a battery, a rechargeable battery, or a user replaceable battery. The security tote may further comprise a pocket which may be disposed on the exterior of the security tote. A speaker may be disposed on the exterior of the security tote.

The speaker may include a microphone for recording sounds and a visual alarm when sensing the unauthorized breach alarm. An amplifier may be in electrical communication with the on-board microprocessor that emits an audible alarm upon sensing the unauthorized breach alarm. A port may be disposed on the exterior of the security tote to provide a removable electrical connection from an external cable or cord to the microprocessor. An indicator may be located directly adjacent to the port to indicate usage. At least one illuminating means may be mounted within the security tote and directed into the interior of the security tote. A display may be disposed on the exterior of the security tote. The display may be a touchscreen user interface that enables entry of a code to permit or deny access to the interior. At least one camera may be in electrical communication with the microprocessor and/or the power supply is disposed on the exterior of the display tote. A wireless transmission receiver may provide remote transmission. A global positioning satellite receiver to provide location data for the security tote. A motion sensor may sense movement.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
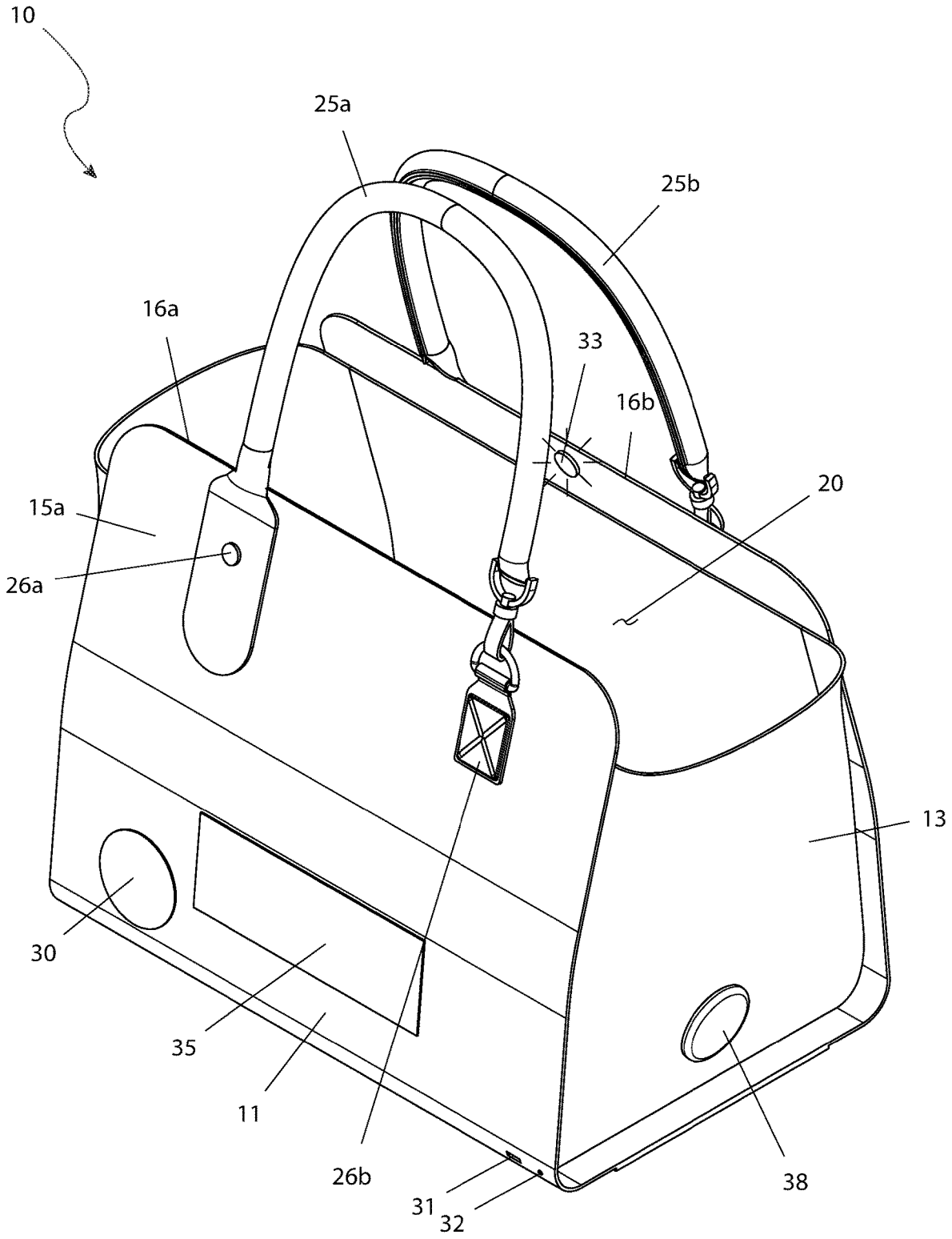
FIG. 1 is a front perspective view of a security tote, according to the preferred embodiment of the present invention.

10 security tote
11 lower front wall
12 lower rear wall
13 side wall
15*a* upper front wall

15*b* upper rear wall
16*a* first tote fastener
16*b* second tote fastener
20 interior
21 pocket
22 pocket fastener
25*a* first handle
25*b* second handle
26*a* first handle fastener
26*b* second handle fastener
30 speaker
31 port
32 indicator
33 illuminating means
35 display
38 camera
50 microprocessor
55 power supply
60 amplifier
65 microphone
70 visual alarm
75 receiver
80 antenna
85 global positioning satellite (GPS) receiver
90 motion sensor

DESCRIPTION OF THE INVENTION

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

DETAILED DESCRIPTION OF THE INVENTION

Referring to FIG. 1, there is a shown a front perspective view of the security tote 10, which is particularly configured to provide access to only an authorized user, and also to document and transmit communication locally and also to a remote location upon identifying unauthorized breach thereof. Such local transmitting can be an audible sound and an illuminating alarm and examples of remote transmitting can be wireless communication with a dedicated application on a personal electronic device, or a remote monitoring facility.

The security tote 10 is preferably constructed out of a flexible, durable, and resilient material or KEVLAR®, to prohibit access an interior 20 thereof. The tote 10 includes a lower front wall 11, an opposing lower rear wall 12, an upper front wall 15*a* attached to or integral with the lower front walls 11, and an upper rear wall 15*b* attached to or integral with the lower rear wall 12. The tote 10 also includes a pair of side walls 13 each attached to or integral with the perimeter side edges of the lower front wall 11, upper front wall 15*a*, lower rear wall 12, and upper rear wall 15*b*.

Coextensive with an upper perimeter edge of the upper front wall 15*a* is a first tote fastener 16*a*. Coextensive with an upper perimeter edge of the upper rear wall 15*b* is a second tote fastener 16*b*. The first tote fastener 16*a* is capable of providing a removable fastening means to the second tote fastener 16*b*, thereby completely sealing the interior 20. Such removable fastening means is envisioned to be an electronic magnetic fastener prohibitively coupled to each other so as to restrict uncoupling when energized.

An on-board microprocessor 50 (not shown) is in electronic communication between the removable fastening means and a power supply 55 located in the interior 20 of the tote 10. Other removable attachment means are envisioned, such as a mechanical lock. A breach of the first tote fastener 16*a* and second tote fastener 16*b*, when sensed, transmits an alert signal to the microprocessor 50, which generates an unauthorized breach alarm for subsequent transmission.

Figure 2:
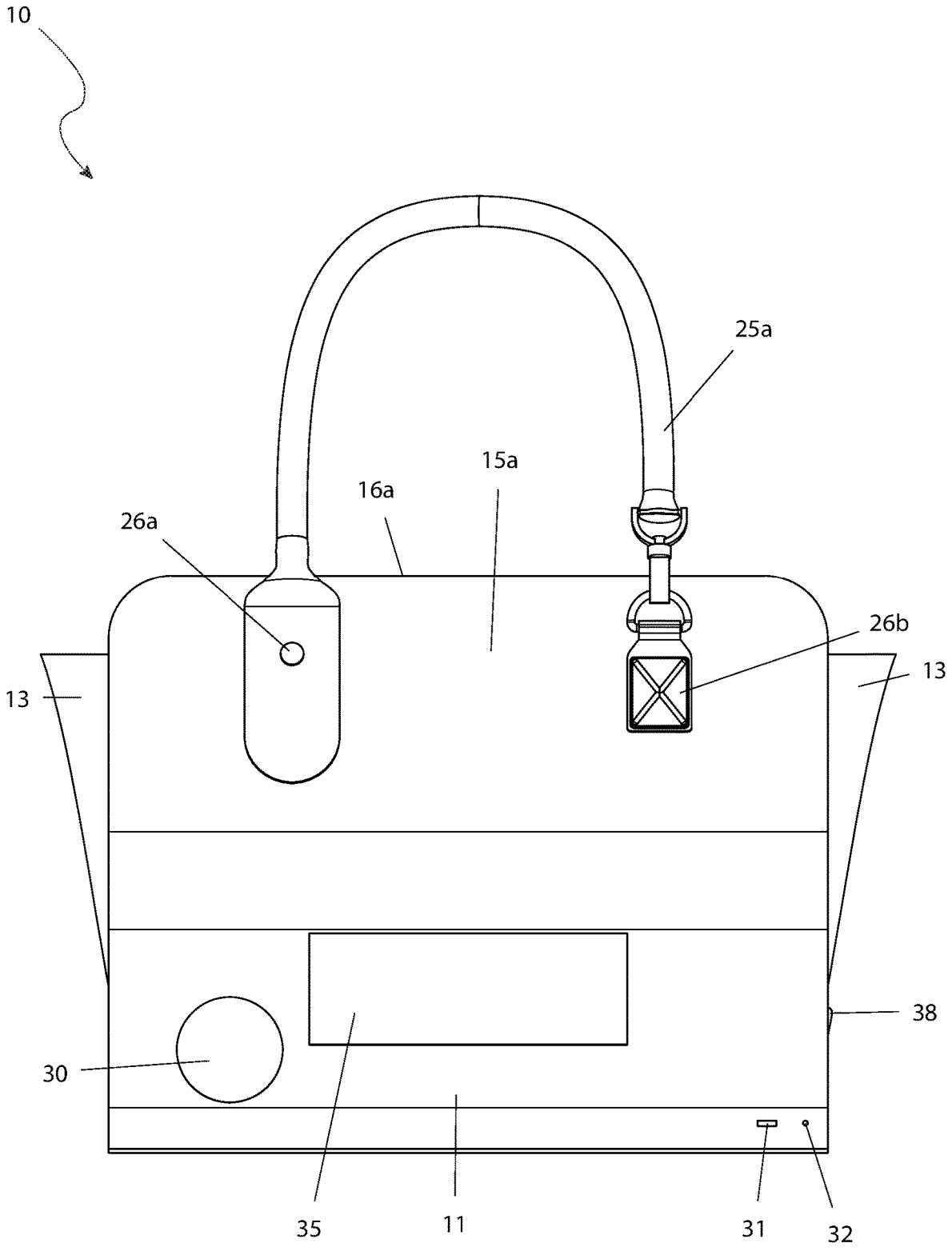
FIG. 2 is a front elevation view of the security tote, according to the preferred embodiment of the present invention.
Figure 3:
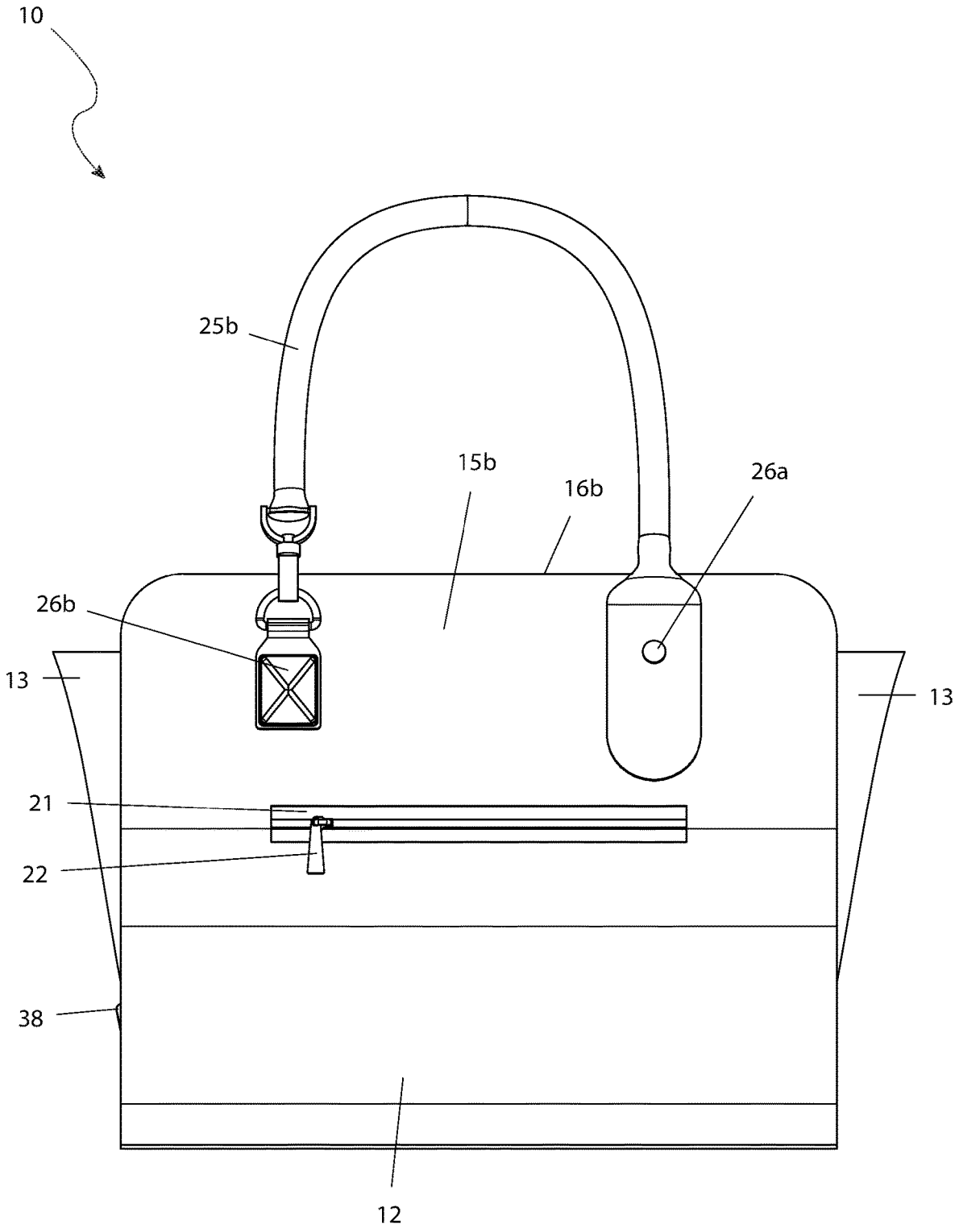
FIG. 3 is a rear elevation view of the security tote, according to the preferred embodiment of the present invention.
Figure 4:
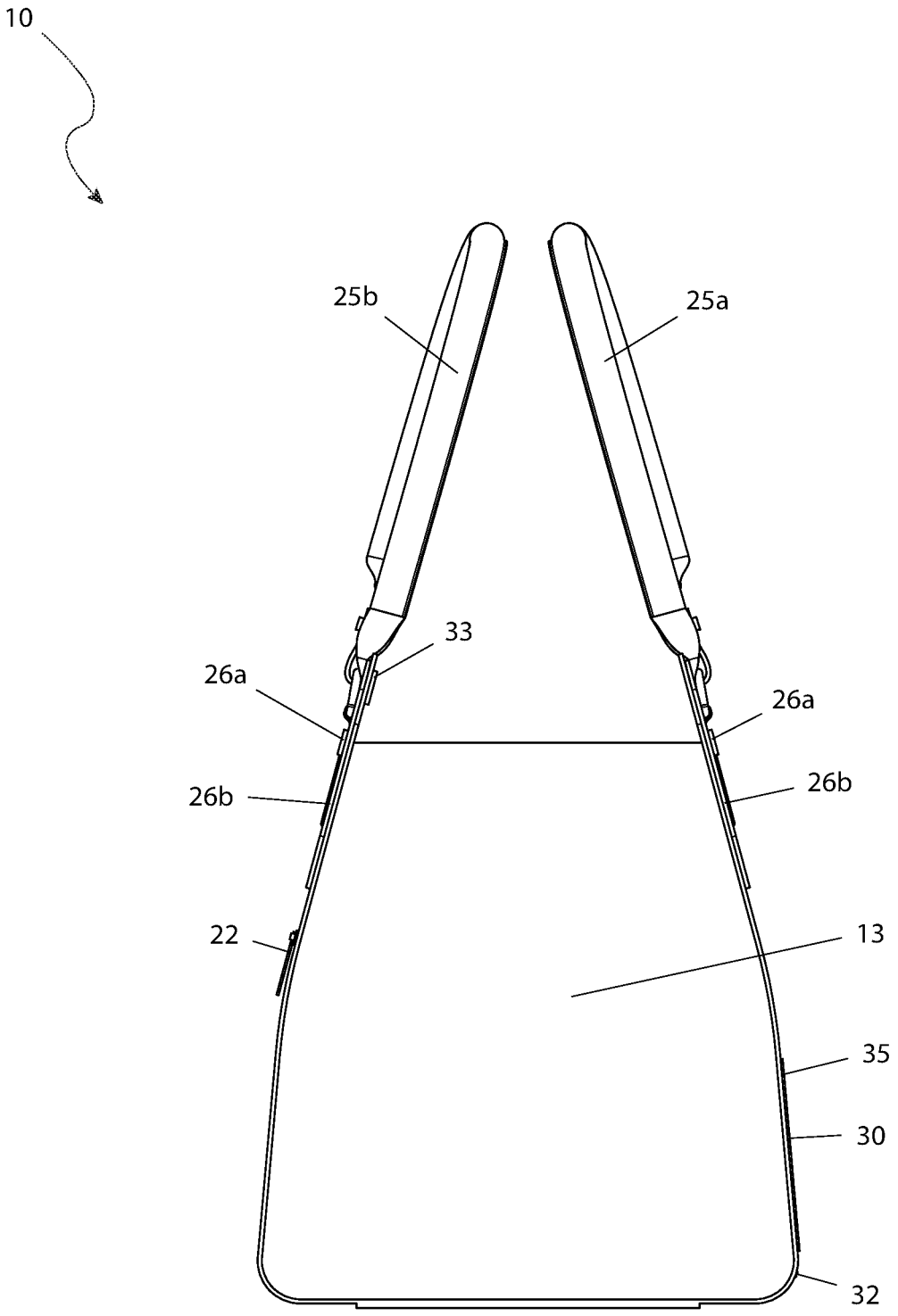
FIG. 4 is a left side elevation view of the security tote, according to the preferred embodiment of the present invention.
Figure 5:
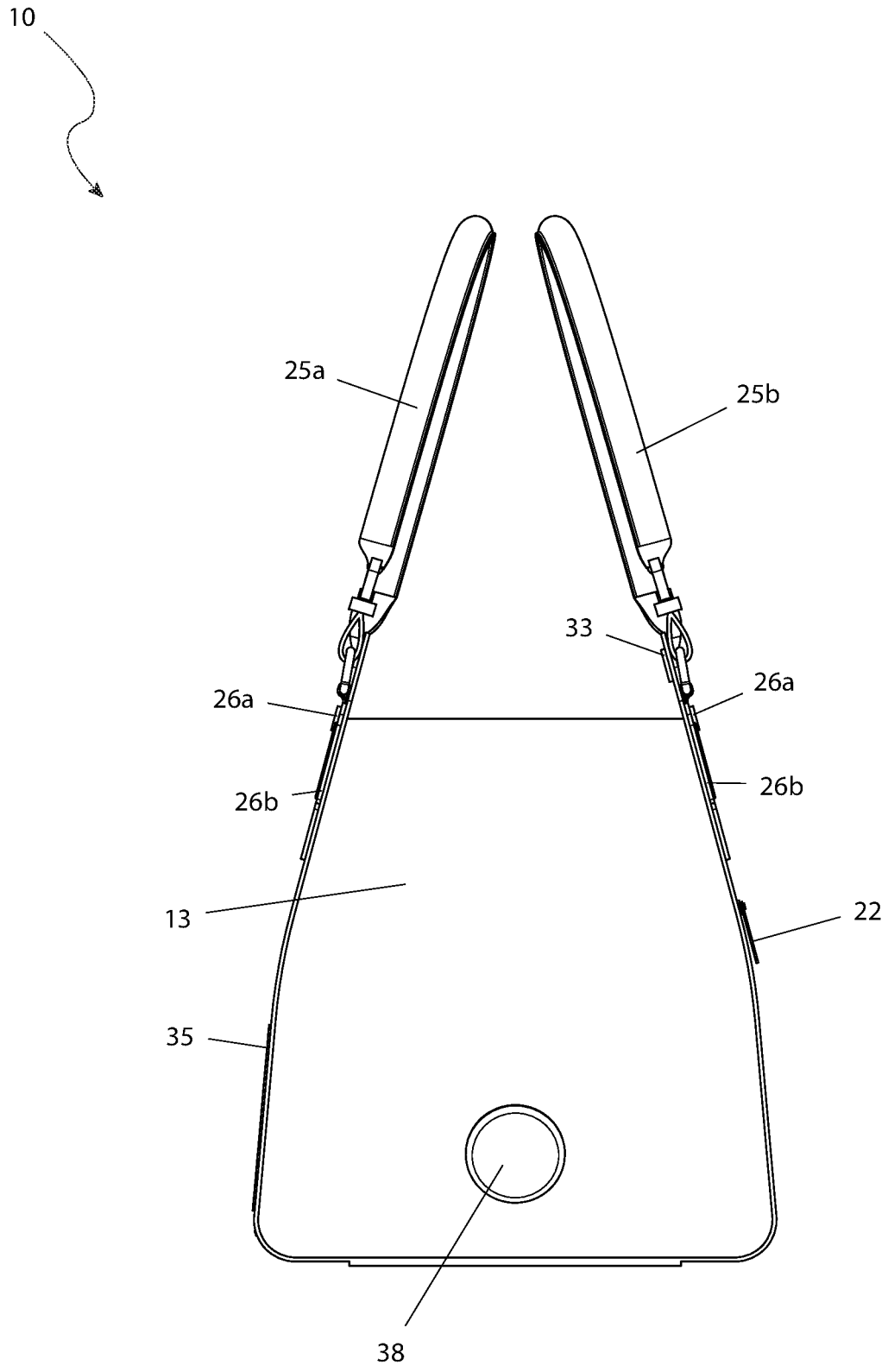
FIG. 5 is a right side elevation view of the security tote, according to the preferred embodiment of the present invention.

A first handle 25*a* has a first end fixedly coupled to a first side (i.e., an exterior wall) of the upper front wall 15*a* with a first handle fastener 26*a* and removably coupled to another area of the first side of the upper front wall 15*a* with a second handle fastener 26*b*. Similarly, a second handle 25*b* has a first end fixedly coupled to a first side (i.e., an exterior wall) of the upper rear wall 15*b* with another first handle fastener 26*a* and removably coupled to another area of the first side of the upper rear wall 15*b* with another second handle fastener 26*b* (as seen in FIG. 2). Exemplary embodiments of the first handle fasteners 26*a* can be rivets or another semi-permanent fastener. Exemplary embodiments of the second handle fasteners 26*b* can be a buckle, a latch, and can also be energized by a power supply 55 in the interior 20.

A pocket 21 may be located on an exterior of the tote 10. In the exemplary embodiment, the pocket 21 is located on the lower rear wall 12 of the tote 10, although other locations are understood to fall under the overall scope of the invention. The pocket 21 may have an opening to provide access to the contents held within. A pocket fastener 22 closes the opening of the pocket 21, herein fashioned as a zipper, although other similar fasteners may be utilized to provide closure to the pocket 21 are envisioned.

Located on an exterior of the tote 10, preferably on the lower front wall 11, is a speaker 30. An amplifier 60 (not shown) is in electrical communication with the microprocessor 50 (not shown) and is particularly suited for emitting an audible alarm upon sensing the unauthorized breach alarm. The audible alarm can be a single repeating sound, a chosen sound from a selected group, or customized. The speaker 30 can also be associated with a microphone 65 for recording sounds and a visual alarm 70 when sensing the unauthorized breach alarm. A port 31 is located on the exterior of the tote 10, also preferably on the lower front wall 11, provides a removable electrical connection from an external cable or cord to the microprocessor 50. An indicator 32 is located directly adjacent to the port 31 to indicate usage thereof. The port 31 can provide power or communication to the microprocessor 50 and any digital memory storage or power supply.

At least one (1) illuminating means 33, also in electrical communication with the microprocessor 50, is mounted within the tote 10 and directed into the interior 20. Such illuminating means 33 can be mounted to any or all second sides (i.e., an interior surface) of the upper front wall 15*a*, upper rear wall 15*b*, an upper location of a side wall 13, the lower rear wall 12, or the lower front wall 11. A display 35 is located on the exterior of the tote 10, also preferably on the lower front wall 11, and is in electrical communication with the microprocessor 50. The display 35 is configured to display any number of operating conditions or selections stored on the microprocessor 50 or a visual alarm 70 as desired. Such a display may also be a touchscreen user interface that enables entry of a code to permit or deny access to the interior 20. At least one (1) camera 38, also in electrical communication with the microprocessor 50 and/or power supply 55, is located on the exterior of the tote 10, such as a lower location on either side wall 13, is configured to collect images from the immediate vicinity of the tote 10 and transmit such collected images for further processing by the microprocessor 50. Such further processing can be collecting and storing video or still images as digital memory, transmitting said video or still images either in batch form or live streaming to a remote location.

Also envisioned to fall under the overall scope of the invention is a wireless transmission receiver 75 or BLUETOOTH™, to provide the remote transmission. A global positioning satellite (GPS) receiver 85 can provide location data for the tote 10. A motion sensor 90 may or may not be associated with the tote 10, which is capable of sensing movement, and if selected, can transmit such a signal to the microprocessor 50. The tote 10 also can function as a Wi-Fi hub for communication purposes. Other means of enabling authorized access to the interior 20 (i.e., decoupling the first tote fastener 16*a* and second tote fastener 16*b*) can be achieved by identified voice command, password entry via the display 35, or password entry via communication with a dedicated application on a personal electronic device, among others.

Figure 6:
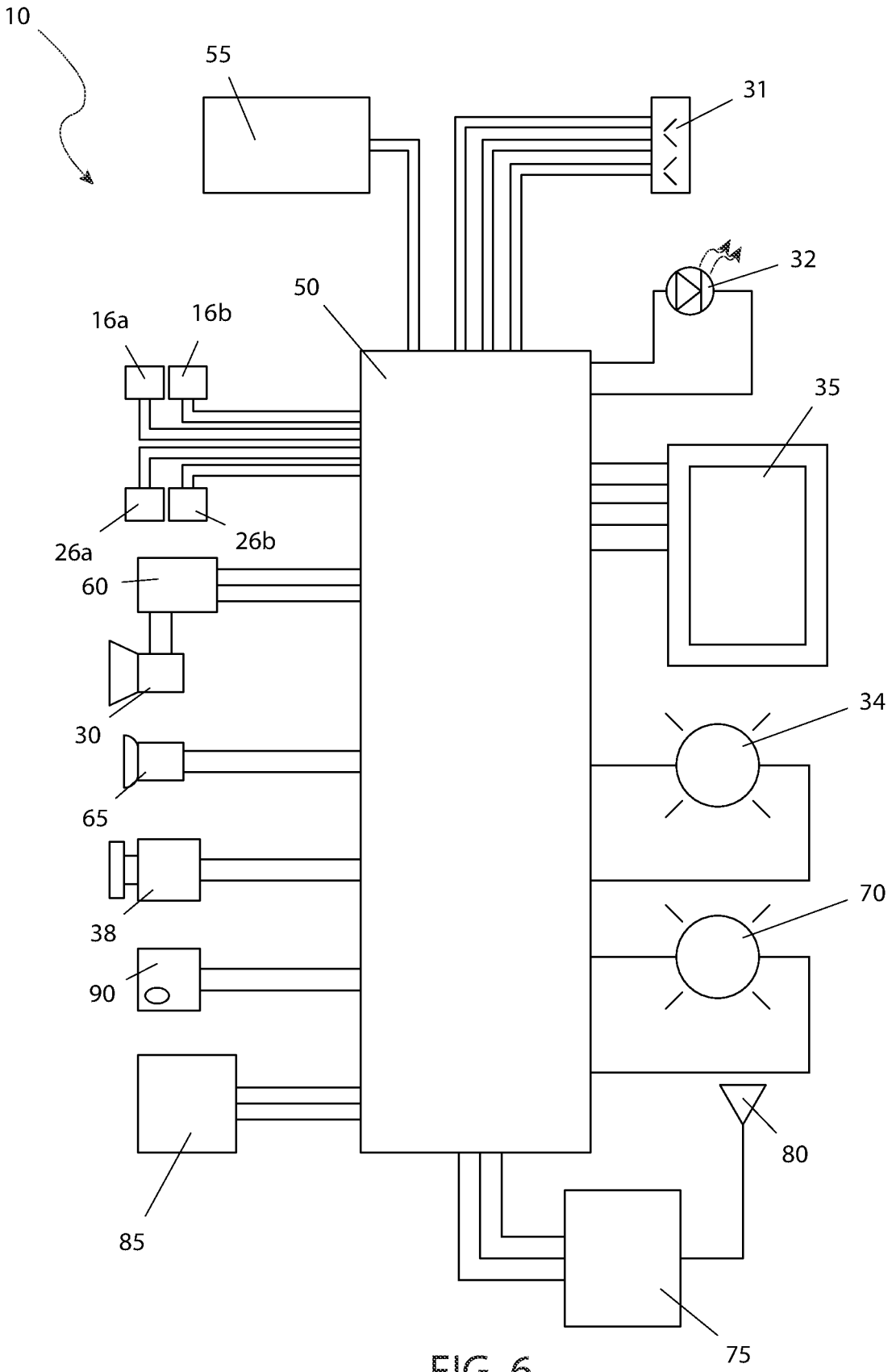
FIG. 6 is an electrical schematic of the security tote, according to the preferred embodiment of the present invention.

Referring to FIG. 6, an electrical block diagram of the security tote 10, according to the preferred embodiment of the present invention. Electrical power for all of the electronic components of the security tote 10 is provided by the power supply 55, such as a rechargeable battery, user replaceable battery, or the like. Resultant power is routed to the on-board processor 50 such as a single board computer (SBC) such as an ARDUINO®, RASPBERYPI®, basic stamp module, or the like. The port 31 and associated indicator 32 are directly connected to the on-board microprocessor 50, such as to allow initial programming, subsequent re-programming, downloading of stored information, and possible recharging of the power supply 55. The on-board microprocessor 50 provides audio output signals to the amplifier 60 and subsequently the speaker 30, for purposes of audible alarm signals. The microphone 65 provides analog input signals to the on-board microprocessor 50 for purposes of audible alarm signals, voice recognition, alarm logging, and the like. Likewise, the camera 38 provides digital input signals to the on-board microprocessor 50 for capturing of video events during alarm activations. The on-board microprocessor 50 provides digital outputs to both the illuminating means 34 and the visual alarm 70 during operational situations as aforementioned described. Likewise, the first tote fastener 16*a*, the second tote fastener 16*b*, the first handle fastener 26*a* and the second handle fastener 26*b* provide both input and output functions to the on-board microprocessor 50 for purposes of initiating a tamper signal or for locking and unlocking the security tote 10. The motion sensor 90 provides digital input signals to the on-board microprocessor 50 as activated by direct movement or vibration. Likewise, the global positioning satellite (GPS) receiver 85 provides digital location signals to the on-board microprocessor 50 for tracking information, retrieval actions, or the like. Wireless communication to and from the security tote 10 are handled by the wireless transmission receiver 75 and associated internal antenna 80, such as cellular signals, Wi-Fi signals, BLUETOOTH® signals, proprietary radio signals or the like. Finally, the display 35, envisioned to be of a touch sensitive nature, provides both input and output functions to the on-board microprocessor 50 as aforementioned described during operation of the security tote 10 by authorized users.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A security tote comprising:

an interior and an exterior;

a lower front wall;

a lower rear wall;

an upper front wall attached to or integral with the lower front wall;

an upper rear wall attached to or integral with the lower rear wall;

a pair of side walls attached to or integral with perimeter side edges of the lower front wall, the upper front wall, the lower rear wall, and the upper rear wall;

a first tote fastener disposed coextensively along an upper perimeter edge of the upper front wall;

a second tote fastener disposed coextensively along an upper perimeter edge of the upper rear wall;

a removable fastening means configured as an electronic magnetic fastener that, when energized by a power supply located in the interior, prohibits uncoupling of the first tote fastener from the second tote fastener to completely seal the interior;

an on-board microprocessor located in the interior and in electrical communication with the removable fastening means and the power supply;

a first handle having a first end fixedly coupled to a first side of the upper front wall by a first handle fastener and a second end removably coupled to another area of the first side of the upper front wall by a second handle fastener;

a second handle having a first end fixedly coupled to a first side of the upper rear wall by another first handle fastener and a second end removably coupled to another area of the first side of the upper rear wall by another second handle fastener;

wherein each second handle fastener comprises a latch that is energizable by the power supply and is in electrical communication with the on-board microprocessor;

a speaker on the exterior;

an amplifier in electrical communication with the on-board microprocessor and the speaker;

a microphone in electrical communication with the on-board microprocessor;

at least one illuminating means mounted within the security tote and directed into the interior;

a visual alarm on the exterior;

a display on the exterior that is a touchscreen user interface configured to receive an authorization code to permit or deny access to the interior;

at least one camera on the exterior in electrical communication with the on-board microprocessor;

a wireless transmission receiver in electrical communication with the on-board microprocessor;

a global positioning satellite receiver configured to provide location data;

a motion sensor configured to sense movement; and, a port on the exterior in electrical communication with the on-board microprocessor, the port having an indicator located directly adjacent to the port; and, wherein the on-board microprocessor is configured to detect a breach by sensing an uncoupling of the first tote fastener and the second tote fastener in the absence of receipt of the authorization code via the display or via the wireless transmission receiver; and wherein, in response to the breach, the on-board microprocessor is configured to: (i) energize the amplifier to emit an audible alarm from the speaker; (ii) activate the visual alarm; (iii) illuminate the interior with the at least one illuminating means; (iv) capture images using the at least one camera; and (v) transmit the captured images together with the location data via the wireless transmission receiver.

2. The security tote of claim 1, wherein:

when the first tote fastener and the second tote fastener are coupled, the on-board microprocessor energizes the latches of the second handle fasteners;

the on-board microprocessor detects tampering by sensing decoupling of any of the second handle fasteners and treats the decoupling as the breach;

the port is configured for programming the on-board microprocessor and for recharging the power supply, and the indicator provides usage status of the port;

the wireless transmission receiver comprises at least one of a cellular transceiver, a Wi-Fi transceiver, and a BLUETOOTH® transceiver; and, the power supply comprises at least one of a rechargeable battery and a user-replaceable battery.

* * * * *